US011678705B2

(12) United States Patent
Polegato Moretti et al.

(10) Patent No.: US 11,678,705 B2
(45) Date of Patent: Jun. 20, 2023

(54) LINING FOR ITEMS OF CLOTHING, FOOTWEAR OR ACCESSORIES

(71) Applicant: GEOX S.P.A., Montebelluna (IT)

(72) Inventors: Mario Polegato Moretti, Crocetta del Montello (IT); Livio Poloni, Caerano di San Marco (IT); Marco Bruno, Ivrea (IT)

(73) Assignee: GEOX S.P.A., Montebelluna (IT)

( * ) Notice: Subject to any disclaimer, the term of this patent is extended or adjusted under 35 U.S.C. 154(b) by 118 days.

(21) Appl. No.: 16/651,056

(22) PCT Filed: Sep. 21, 2018

(86) PCT No.: PCT/EP2018/075567
§ 371 (c)(1),
(2) Date: Mar. 26, 2020

(87) PCT Pub. No.: WO2019/063426
PCT Pub. Date: Apr. 4, 2019

(65) Prior Publication Data

US 2020/0229523 A1 Jul. 23, 2020

(30) Foreign Application Priority Data

Sep. 27, 2017 (IT) ..... 102017000107834

(51) Int. Cl.
*A41D 27/02* (2006.01)
*A41D 31/14* (2019.01)
(Continued)

(52) U.S. Cl.
CPC ..... *A41D 27/02* (2013.01); *A41D 27/28* (2013.01); *A41D 31/14* (2019.02); *A43B 23/07* (2013.01)

(58) Field of Classification Search
CPC ..... A41B 11/00; A41B 11/003; A41B 11/008; A41B 11/02; A41B 11/126; A41B 11/128;
(Continued)

(56) References Cited

U.S. PATENT DOCUMENTS 641,572 A * 1/1900 Arnsfield et al. ..... A43B 7/06 36/3 R
2,451,758 A * 10/1948 Malm ..... A41D 19/0062 2/168
(Continued)

FOREIGN PATENT DOCUMENTS

CN 1741754 A 3/2006
CN 103619202 A 3/2014
(Continued)

OTHER PUBLICATIONS

English language translation of Chinese Office Action dated Apr. 30, 2021 in Chinese Patent Application No. 2018800627461, 4 pages.
(Continued)

*Primary Examiner* — Alissa L Hoey
*Assistant Examiner* — Patrick J. Lynch
(74) *Attorney, Agent, or Firm* — Oblon, McClelland, Maier & Neustadt, L.L.P.

(57) ABSTRACT

A lining for items of clothing, footwear and accessories, including a fabric with a plurality of channels which are alternated with ribs, the channels at least partly have a differentiated width.

10 Claims, 4 Drawing Sheets

(51) Int. Cl.
*A41D 27/28* (2006.01)
*A43B 23/07* (2006.01)

(58) Field of Classification Search
CPC .... A41D 27/02; A41D 27/06; A41D 13/0156; A41D 2400/24; A41D 2400/322; A41D 2400/82; A41D 27/28; A43B 23/07; A43B 7/06; A43B 7/146; A43B 17/08; A43B 17/10; A43B 5/0405; A43B 5/1675
See application file for complete search history.

(56) References Cited

U.S. PATENT DOCUMENTS 2,782,619 A * 2/1957 Bialostok ..... A41D 1/04 2/90
5,052,053 A * 10/1991 Peart ..... A41D 31/065 2/2.16
5,515,543 A * 5/1996 Gioello ..... A41D 27/28 2/69
5,708,985 A * 1/1998 Ogden ..... D04B 1/04 2/239
7,159,621 B2 * 1/2007 Shannon ..... A41C 1/02 2/221
11,213,082 B1 * 1/2022 Yang ..... A41D 1/08
2004/0006291 A1 4/2004 Morrison
2006/0143801 A1 7/2006 Lambertz
2006/0277786 A1 12/2006 Vattes et al.
2006/0277787 A1 * 12/2006 Vattes ..... A43B 17/102 36/3 A
2008/0078008 A1 * 4/2008 Demarest ..... A41D 7/00 2/115
2011/0010828 A1 1/2011 Morrison
2012/0174282 A1 * 7/2012 Newton ..... A41D 31/185 2/69
2013/0219579 A1 * 8/2013 Molyneux ..... A41D 13/012 2/2.15
2013/0232824 A1 * 9/2013 Bier ..... A43B 7/06 36/3 A
2014/0208479 A1 * 7/2014 Lambertz ..... A41D 1/04 2/69
2014/0259322 A1 * 9/2014 Henry ..... A63B 71/12 2/455
2014/0366585 A1 * 12/2014 Shen ..... D04B 21/207 66/175
2015/0047103 A1 2/2015 Dahlgren et al.
2016/0338417 A1 * 11/2016 Kehler ..... A61F 13/08
2017/0106015 A1 * 4/2017 Helmick ..... A61K 9/0014
2017/0150783 A1 * 6/2017 Polegato Moretti ... D04B 21/16
2017/0340027 A1 * 11/2017 Montoya ..... A41D 31/06
2020/0399801 A1 * 12/2020 Ogden ..... D04B 1/265

FOREIGN PATENT DOCUMENTS

CN 106659268 A 5/2017
DE 203 00 973 U1 3/2003
EP 1 367 913 A1 12/2003
WO WO 2007/143980 A1 12/2007
WO WO 201 5/193385 A1 12/2015

OTHER PUBLICATIONS

Extended European Search Report dated Jan. 29, 2021 in European Patent Application No. 20197514.1, 8 pages.
International Search Report and Written Opinion dated Jan. 24, 2019 in PCT/EP2018/075567 filed on Sep. 21, 2018.
Office Action dated Dec. 14, 2021 in corresponding Chinese Patent Application No. 2018800627461 (English Translation only), 4 pages.

* cited by examiner

LINING FOR ITEMS OF CLOTHING, FOOTWEAR OR ACCESSORIES

The present invention relates to a lining for items of clothing, footwear and accessories for clothing, such as for example gloves, rucksacks and bags.

The invention also relates to an item of clothing and footwear provided with said lining.

Garments worn by man, both footwear and clothing, interact with the human body for example by applying a contact pressure in the points where the garment comes into contact with the human body. Said pressure is due for example to the weight of the garments themselves and to the tension of the fabrics that normally compose them.

Garments are in contact with the body of the user more or less continuously: for example, on the top of the shoulders contact is substantially continuous and constant, since the weight of the item of clothing itself pushes the item downward, where it encounters the body of the user.

The anatomy of the human body is such that for example a hollow is created along the spinal column with respect to the dorsal region directly below the top of the shoulders and at the sides of the spinal column. This hollow extends to the sides. This causes the item of clothing to adhere more to the body in the dorsal region directly below the top of the shoulders and at the sides of the spinal column and to be less in close contact with the body of the user at the spinal column.

The contact pressure is higher where contact is greater, for example, due to the greater weight of the fabric, or due to the greater tension to which the yarn of which the fabric is made is subjected.

Considering for example a coat or jacket, on the top of the shoulders the contact pressure is determined mainly by the weight of the item itself, whereas at the dorsal region, directly below the top of the shoulders, and at the sides of the spinal column the contact pressure is determined predominantly by the tension of the fabric.

FIG. 1 shows schematically the differences in contact pressure in the various regions of a back of a man in motion.

In the region of the spinal column, designated by the letter A, the contact pressure is substantially nil.

In the regions below the top of the shoulders and at the sides of the spinal column A, designated by the letter B, the contact pressure reaches values of 0.7 kPa.

In the region of the sides, designated by the reference letter C, the contact pressure reaches even greater values up to 1.2 kPa.

In the lumbar region, designated by the letter D, the pressure is once again substantially nil.

In the region of the sacrococcygeal articulation, the pressure is substantially nil.

In the central region, designated by the letter E, the contact pressure is substantially nil but rises up to 0.7 kPa in the two external regions F.

The human body itself, in turn, applies pressure to the garment. This pressure is due for example to the weight of the body or to its motion.

Therefore the garments must be suitable to dress effectively and comfortably the human body, for example without collapsing under the weight of the body itself or sagging for example under their own weight or also compressing some regions excessively.

It is known that the human body has regions that are more or less rich in sweat glands, which produce sweat suitable to cool the body by evaporation due to body heat.

FIGS. 2*a* and 2*b* are schematic views of the distribution of the sweating regions respectively in a front view and a rear view of a human body.

The values of sweating in the various regions of the body are given in the following table.

| Region | Sweating [g/(m$^2$*h)] |
|---|---|
| G | 100-200 |
| H | 200-300 |
| I | 300-400 |
| L | 400-500 |
| M | 500-600 |
| N | 600-700 |
| O | 700-800 |
| P | 800-1000 |
| Q | 1000-1250 |

In order to maintain an effective thermoregulation of the human body, it is important that sweat in the vapor phase moves away from the body; this in order to avoid condensing inside the garments, generating a sensation of wetness and discomfort.

The requirements described above are present simultaneously, but to different extents, in the various regions of the human body.

In particular, these requirements occur on the shoulders, in the dorsal region, in the vertebral region, on the sides, on the feet.

It is therefore necessary to provide garments in which the portions in contact with the human body, generally the lining of outerwear or of footwear, are able to meet these requirements in a diversified manner.

Contact pressures of a different value depending on the region of the foot being considered also occur within footwear between the lining or the internal surface of the upper and the foot.

It is known that in static conditions the foot has three resting regions: rear resting at the calcaneus, anterolateral resting at the head of the fifth metatarsal bone, and anteromedial resting, at the head of the first metatarsal bone and at the sesamoid bones.

Said three resting regions determine the presence of three plantar arches:

- an anterior arch, formed by the five metatarsal heads;
- a lateral longitudinal arch, between the calcaneus and the head of the fifth bone of the metatarsus;
- a medial longitudinal arch, formed by the heel, the astragalus, by the scaphoid, by the first cuneiform bone and by the first metatarsal bone;

the scaphoid is at the apex of the arch.

During motion, resting of the foot is organized into three phases:

- first phase: contact of the ground with the rear region of the heel, taligrade time;
- second phase: resting on the region of the heel, of the forefoot and on the lateral margin of the foot at the lateral longitudinal arch, plantigrade time;
- third phase: resting only on the forefoot, with progressive release of the resting on the metatarsal heads from the outside inward, digitigrade time.

This means that both in the static phase and during motion, resting of the foot occurs to a large extent on the lateral section of the sole and that the medial section in the median region of the foot is only minimally involved in the resting of the foot.

For these reasons, the support and ventilation requirements are different.

Currently it is widespread practice to provide items of clothing, footwear or accessories that allow the body of the user effective thermal regulation.

For example, WO2015193385A1, in the name of this same Applicant, contains the teachings to provide a ventilated shoe, in which an upper assembly comprises an internal lining which in turn is constituted at least partially by a first element which forms at least one interspace which separates the foot of the user from said external upper and has preferential passages for sweat, moving away from the foot of the user, toward the upper external edge of the shoe. The shoe described in the cited document also comprises a vapor-permeable insole, which is joined perimetrically at least to the internal lining, which forms at least one interspace for spacing the foot of the user from the sole. The combined characteristics of the channeled lining and of the insole promote ventilation all around the foot.

However, this prior art has some drawbacks.

All the channels of the lining have a substantially constant width and a substantially parallel arrangement, which is oriented from the lower part toward the upper part of the shoe. However, with such an arrangement the different requirements of the various regions of the foot in terms of sweat evacuation are not considered: it is in fact known that in the regions where blood supply is greater there is a greater production of heat, and in the regions where the sweat glands are more present there is a greater production of sweat.

These regions therefore require greater ventilation to cool the foot and carry the sweat away from the foot.

Furthermore, the insole simply has an interspace that spaces the foot of the user from the sole and therefore there are no regions that provide a more stable resting to the foot on which the weight of the user rests, for example the heel.

EP 1723863A1 contains the teachings for providing a shoe which comprises a lining constituted by a succession of parallel hollow channels and a perforated insole, a first series of spacer elements which are appropriately spaced and a lower insole.

Some drawbacks are present in this prior art as well.

In such a shoe, the air is not channeled into the spaces between one channel and the other at any height but inside the channels only starting from the lower portion of the foot. For this reason, a large portion of the lining remains excluded from the extraction of the humid warm air.

US2016/0213090 is also known which teaches the provision of a ventilation system, incorporated in a shoe, which comprises a ventilated midsole which is inserted in the upper and at least one ventilated flap, which are joined monolithically and form passages for the air within the shoe.

This embodiment, in addition to requiring the manufacture of an additional component with respect to the traditional shoe, i.e., the flap, does not define regions with different loadbearing capacity depending on the load applied by the foot of the user and also does not provide for shaping at the air passages that is proportionate to the different degree of sweating that the different areas of the foot have.

EP1367913B1 contains the teachings for implementing a fabric which comprises a porous layer, with the porosity in the longitudinal direction of the layer. Said fabric can have surfaces that are impermeable to the fluid, for example air, that passes through the porous layer, and channels.

However, there are some aspects that can be improved.

The air is unable to pass through the fabric in a transverse direction, consequently penalizing the effect of ventilation. Moreover, the channels do not allow, except in limited regions, to optimize the ventilation of the body of the user by following its anatomical shape.

EP1266584B1, in the name of this same Applicant, claims a multilayer fabric which comprises an internal layer and an external layer, both made of a material capable of distributing sweat, and an intermediate layer, made of a material that is capable of transferring the condensed sweat the item outward.

However, this solution has the following drawback: the internal layer is hydrophilic and therefore does not allow continuous and linear outward evacuation of the vapor and consequently causes condensation within the item of clothing. Furthermore, there is no channel system that allows the evacuation of the vapor along the fabric but only through it.

In order to overcome said drawback, this same Applicant has filed EP2007235B1, which claims a multilayer fabric comprising: a first hydrophobic and vapor-permeable layer, which is arranged in a channeled form towards the user and removes the sweat in the liquid phase and in the vapor phase from the user; a second intermediate hydrophobic layer, which transfers the sweat in the liquid phase from the first layer, which is internal, to the third layer, which is external, and transfers the sweat in the vapor phase from the first layer, which is internal, outward; a third external hydrophilic layer, which facilitates the outward evaporation of the sweat.

Said fabric is processed on weft and warp looms: the filaments of the second layer are woven inside the strips of the first layer and third layer; however, the channels have directions which are substantially mutually parallel and do not allow differentiation by regions according to the different requirements.

The aim of the present invention is to provide a lining that is capable of improving the prior art in one or more of the aspects indicated above.

Within this aim, an object of the invention is to provide a lining that is capable of ensuring better disposal of sweat both in the vapor phase and in the liquid phase with respect to known ones.

Another object of the invention is to provide a lining that is capable of allowing the footwear or item of clothing in which it is used ventilation around the body of the user for correct exchange of heat and water vapor between the microclimate that is generated within the footwear or item of clothing and the external microclimate, even if the external material of the footwear or item of clothing is not vapor-permeable.

A further object of the invention is to provide a lining that produces a footwear or item of clothing, in which it is used, that is physiologically more comfortable, allowing natural thermoregulation of the body of the user, thus allowing to keep it dry longer.

A further object of the present invention is to overcome the drawbacks of the background art in a manner that is alternative to any existing solutions.

Another object of the invention is to provide a lining for items of clothing, footwear and accessories that is highly reliable, relatively easy to provide and at competitive costs.

This aim, as well as these and other objects which will become better apparent hereinafter, are achieved by a lining for items of clothing, footwear or accessories according to claim 1, optionally provided with one or more of the characteristics of the dependent claims.

Further characteristics and advantages of the invention will become better apparent from the description of some preferred but not exclusive embodiments of the lining for items of clothing, footwear and accessories according to the invention, illustrated by way of nonlimiting example in the accompanying drawings, wherein:

FIG. 3 is an internal exploded view of a jacket provided with a lining according to the invention;

FIGS. 4*a*, 4*b*, 4*c* are each a sectional view of three particular regions of the lining of FIG. 3;

Figure 1:
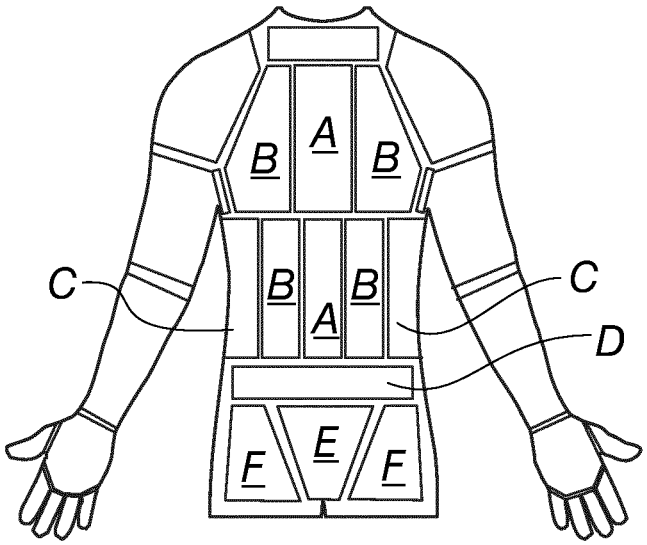

Considering FIG. 1 cited above, the regions where the contact pressure is particularly low are suitable to facilitate ventilation within the item of clothing, for example by using three-dimensional fabrics, advantageously provided with channels produced by ribs.

Said channels are designed to guide sweat in the vapor phase and warm air, both contained inside the item, upward from below, by stack effect, for example toward a plurality of openings located in the upper region of the item.

Vice versa, in the regions where the contact pressure is greater, a larger surface of contact with the body is required in order to distribute the contact pressure on a larger surface in order to improve user comfort.

The regions in which contact pressure is greater require a more consistent lining structure, i.e., with a greater density, which can be obtained for example by arranging the ribs that form the channels at a smaller mutual distance.

In particular, the region of the spinal column along a medial plane of the item of clothing is instead adapted to comprise a channeled fabric that has channels formed by ribs that have a greater mutual distance. This produces a fabric that has a lower density, which is in any case sufficient to withstand a lower contact pressure.

Said channels are oriented predominantly along an upward direction from below of the item of clothing, in order to guide effectively the warm air and the sweat in the vapor phase toward a plurality of exit openings, advantageously arranged in the upper region of the item, by stack effect.

As appears evident in FIG. 1, the contact pressure is predominantly low if not nil also in the region of the sides at the level of the kidneys.

These regions are adapted to interface with a channeled fabric provided with channels that are similar to the ones that are present in the region of the spinal column and which can blend with it. In this manner, the sweat produced by the glands that are located proximate to the armpit also can be guided away from the body of the user. This sweat condenses and descends along the sides and from there can evaporate again due to body heat.

Figure 2A:
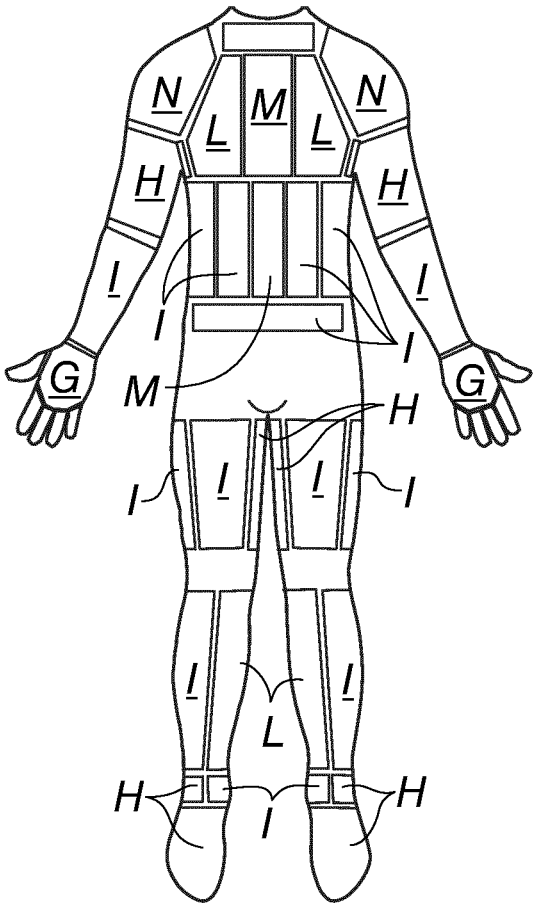
Figure 2B:
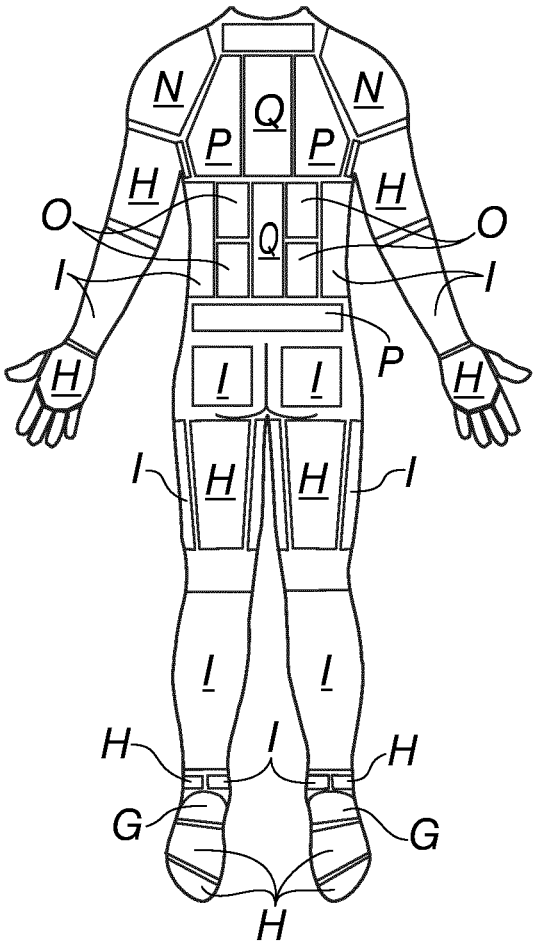

Considering FIGS. 2*a* and 2*b* cited above, it is evident that the region of the spinal column is particularly affected by the phenomenon of sweat production; therefore, in this region adequate ventilation is necessary in order to ensure effective thermoregulation of the human body.

FIGS. 2*a* and 2*b* also evidently show that sweating at the shoulders and at the dorsal regions, directly below the top of the shoulders and at the sides of the spinal column, has a far from negligible importance. In these regions, therefore, the requirements of support and adequate ventilation are combined.

Figure 3:
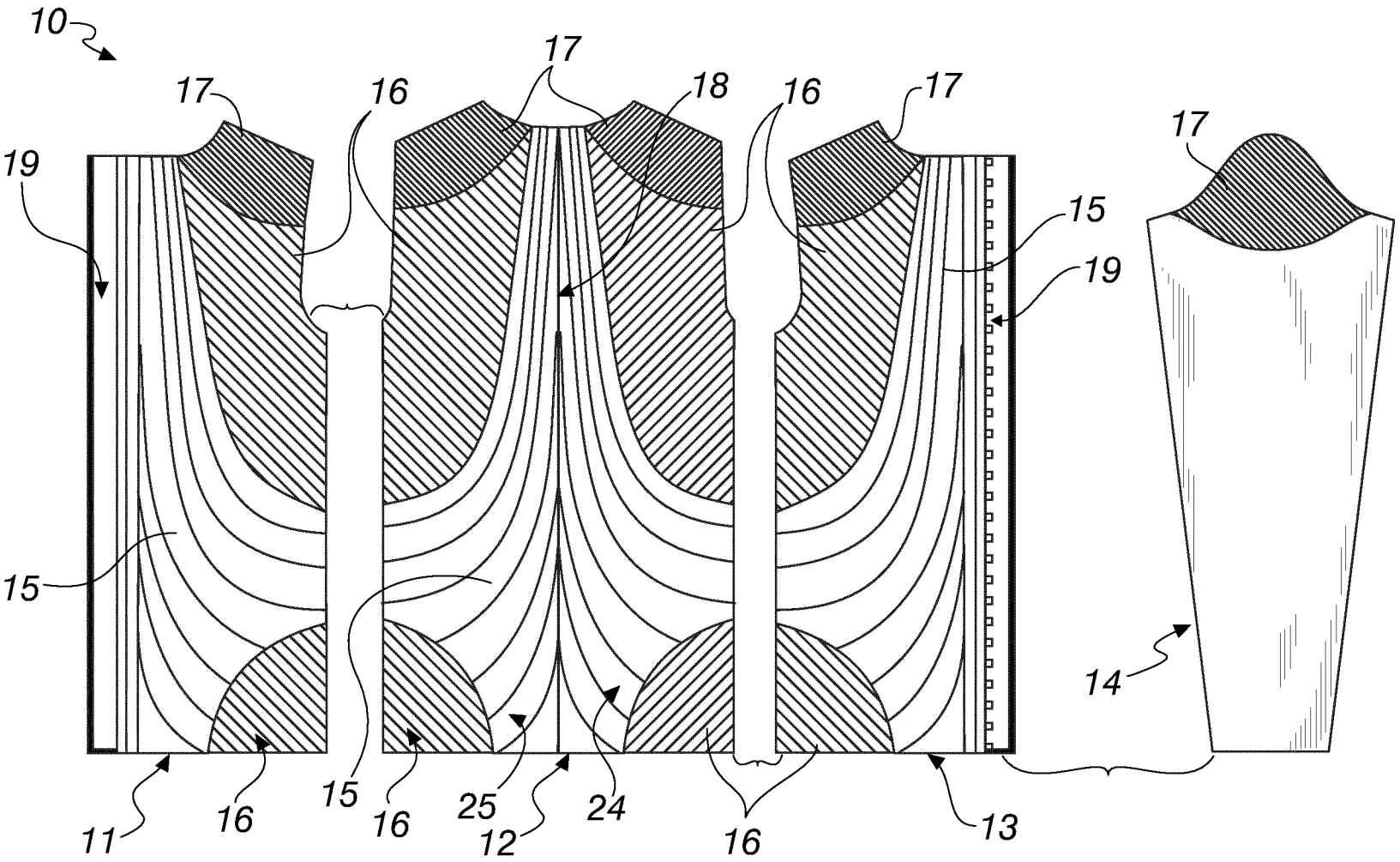

Considering what is described above, a lining according to the invention applicable to a jacket is shown in FIG. 3.

The lining that represents the internal layer of an item of clothing is designated generally by the reference numeral 10.

Said lining comprises a plurality of channels, alternated with ribs, which have at least partly a differentiated width. Said channels have a non-rectilinear extension. In some regions two or more channels can merge into a common channel.

The lining 10 comprises a right front part 11, a rear part 12, a left front part 13 and two sleeves 14.

The rear part 12 is in contact with the back of the user, while the right front part 11 and the left front part 13 are in contact with the front section of the body.

The right front part 11 and the left front part 13 are defined with respect to an orientation that is integral with the user.

Each one of the three parts 11, 12 and 13 comprises three regions of fabric that have a different density.

Each region has a plurality of ribs 24 spaced by channels 25.

In particular, low-density regions 15, medium-density regions 16 and high-density regions 17 are present.

The different density is defined on the basis of the mutual distance between the ribs, therefore on the different channeling of the fabric, i.e., on the density of the channels.

During the assembly of the jacket, which occurs in a per se known manner, the rear part 12, the right front part 11, the left front part 13 and the sleeves 14 are rendered mutually integral by interfacing the regions with the same density and blending the channels.

The channels of the fabric according to the invention follow an arrangement which is shown schematically in FIG. 3.

The ribs and the channels that are present in the low-density regions 15 follow a predominantly vertical orientation proximate to the spinal column 18 and proximate to the front closure 19 of the item.

Figure 4A:
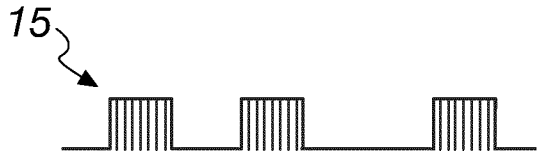
Figure 4B:
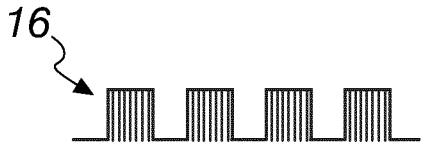
Figure 4C:
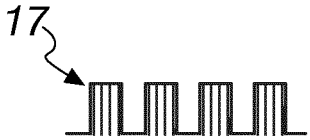

FIGS. 4*a*, 4*b* and 4*c* show cross-sections respectively at low-density regions 15, medium-density regions 16 and high-density regions 17.

In the low-density regions 15, the direction of the ribs and of the channels assumes an angle that increases progressively, with respect to the spinal column 18 and the closure of the item 19, determining an angle which, starting from 0° at the spinal column 18 and at the front closure of the item 19, tends to 90° at the sides of the item.

In this manner, the humid warm air moves from the sides of the item toward the predominantly vertical channels, proximate to the spinal column 18 and the closure of the item 19, along to a path that is free from obstacles, avoiding in particular passing through regions of fabric with higher density which would slow its path and would increase the likelihood of condensation of the sweat in the vapor phase.

In the medium-density regions 16, it is necessary to provide at the same time adequate ventilation and adequate support to the lining: the ribs therefore are mutually closer with respect to the low-density regions and the channels have a narrower width.

Furthermore, the ribs and the channels form an angle comprised between 30° and 60° with respect to the spinal column 18 and preferably between 40° and 50°.

Such an orientation allows to make the humid air follow the shortest path, intercepting the channels proximate to the spinal column 18 and the front closure 19.

Advantageously, the breadth of the described angle is determined as a function of the vertical extension of the item of clothing, i.e.: as the size of the item of clothing increases, the vertical extension of said item increases and the breadth of the described channel angle decreases.

In the high-density regions 17, the channels can trace paths for moving the humid warm air away from the body that are shorter than those that characterize the medium-density regions 16 and the low-density regions 15.

The high-density regions 17 are in fact located at the top of the shoulders, i.e., in the apex region of the body, in which there are exit openings not shown in the figure.

In the high-density regions 17, the channels intercept at least partially the channels of the medium-density region 16 in order to reduce the interruptions of flow of the humid warm air.

In particular, the channels of the high-density regions 17 maintain a substantially uniform inclination in order to avoid sudden redirections of the flow of the humid warm air and contain the risk of condensation of the sweat in the vapor phase.

Like in the medium-density regions 16, in the high-density regions 17 also the channels trace an angle comprised between 30° and 60° with respect to the spinal column 18 and to the front closure 19 and preferably between 40° and 50°.

The ribs and the channels are preferably sized so that the high-density regions 17 have ribs which are mutually closer and the average width of the channels is smaller than the medium-density regions 16: a larger number of channels per unit surface is present in these regions 17.

Figure 5:
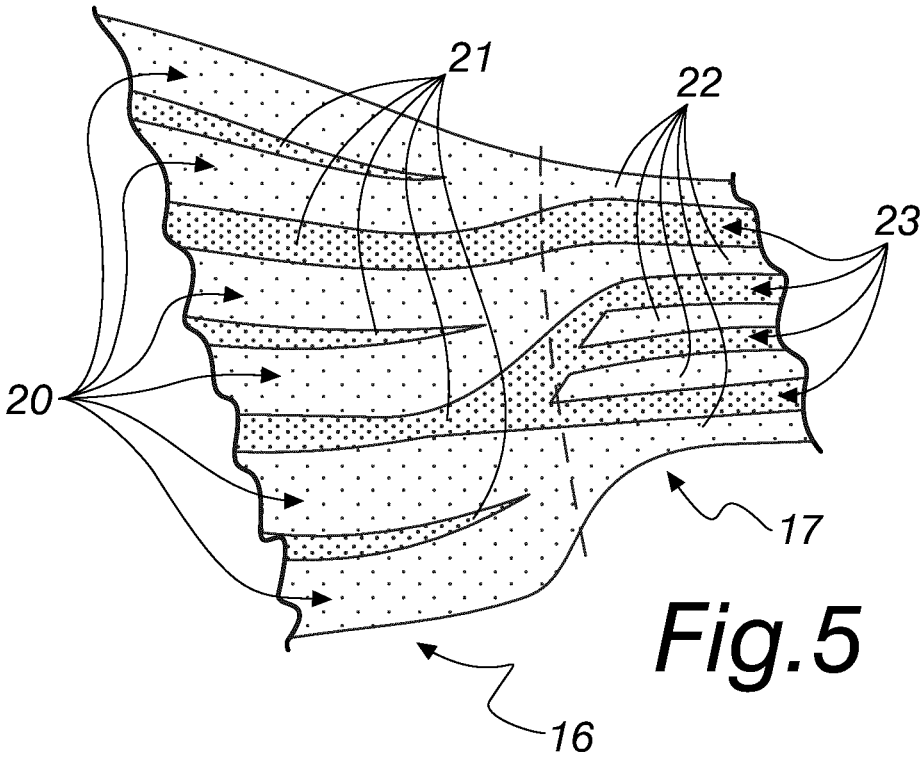
FIG. 5 is a view of a detail of the exploded view of FIG. 3.

For these reasons, with reference to FIG. 5, in order to link said two regions, multiple channels 20 of the medium-density region 16 can merge into a same channel 22 of the high-density region 17 and a rib 21 of the medium-density region 16 can branch into multiple ribs 23 in the high-density region 17.

The ribs have a thickness of no less than 0.5 mm and preferably comprised between 0.5 and 4 mm.

The channels have an average width, between two successive ribs, comprised between 1 mm and 20 mm.

Preferably, the channels have a transverse cross-section of less than 15 $mm^2$ in order to reduce the risk of collapse of the lining and not to slow excessively the flow of the sweat in the vapor phase, reducing the risk of condensation.

In particular, in the low-density regions 15 the ribs have a width comprised between 1 and 4 mm and the channels have a width comprised between 6 and 20 mm.

In the medium-density regions 16 the ribs have a width comprised between 2 and 5 mm and the channels have a width comprised between 3 and 6 mm.

In the high-density regions 17 the ribs have a width comprised between 1 and 7 mm and the channels have a width comprised between 1 and 3 mm.

Figure 6:
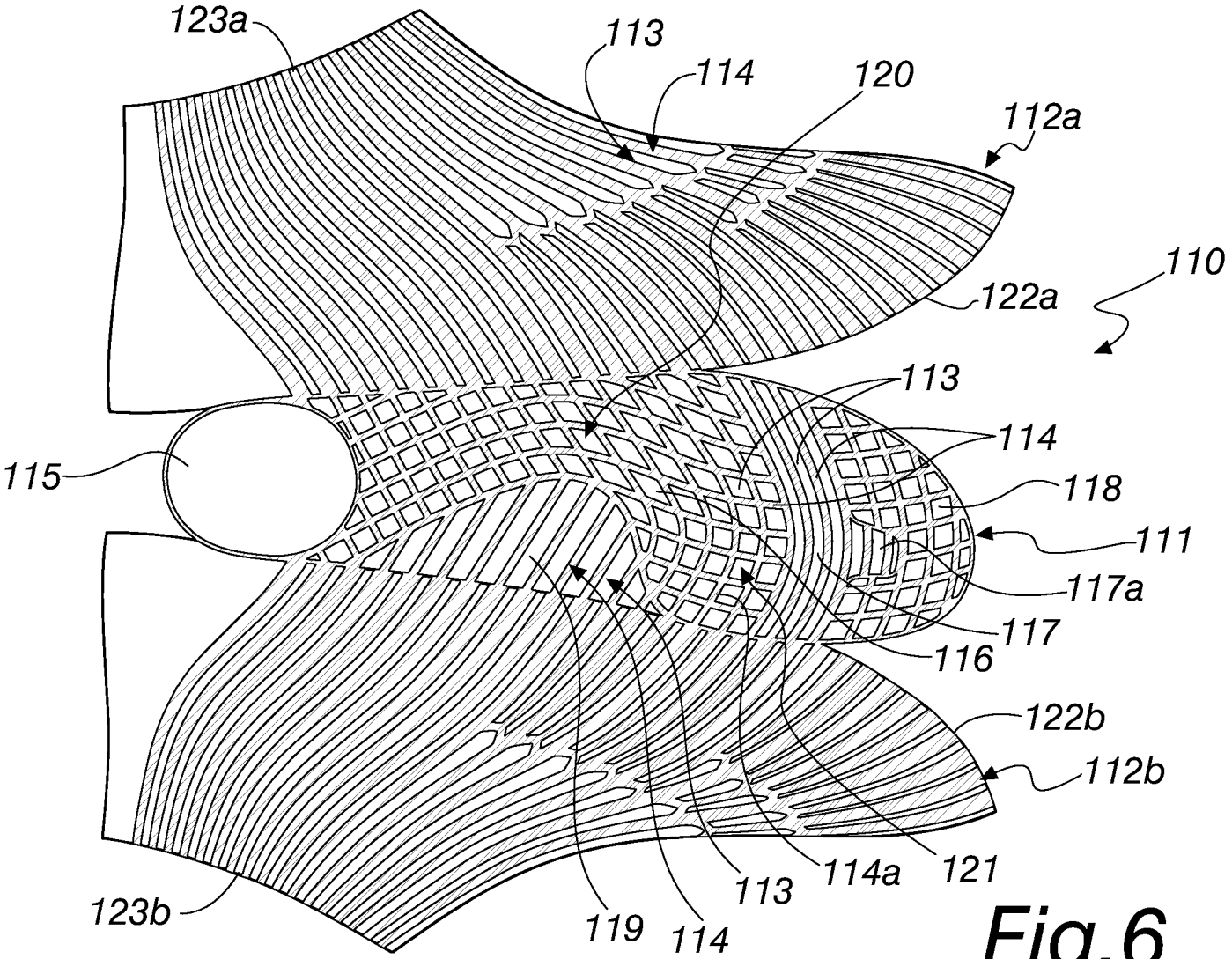
FIG. 6 is an exploded view of the inside of a shoe provided with a lining according to the invention.

With reference to FIG. 6, a lining according to the invention applicable to footwear is designated generally by the reference numeral 110.

It comprises a central portion 111, which corresponds to the region interfaced with the sole of the foot, and two lateral portions 112*a* and 112*b*, which correspond to the planar extension of the surface of the foot except the surface of the sole 111.

The three portions can be provided individually by joining multiple pieces and connected subsequently.

In particular, the lining 110 comprises preferential passages, located in very precise areas defined by channels 114, for the passage of the sweat in the vapor phase, which are delimited by ribs 113.

The term "preferential" in the context of the patent has the meaning of "subject to preference" on the part of the sweat in the vapor phase, which, when it encounters a material that has a region with passages and a region without, is attracted by the passages and is subject to "prefer" them. Accordingly, it is subject to prefer the region that contains the passages with respect to the region that lacks them.

The central portion 111 comprises six regions defined by a different density of the lining.

Specifically, the central portion 111 comprises: a heel region 115, an external lateral median region 116, which corresponds to the projection of the lateral longitudinal arch 120, a region of the heads of the metatarsal bones 121, an internal lateral median region 119, comprised between the heel 115 and the heads of the metatarsal bones 121, a distal forefoot region 118, which corresponds to the distal surface, and an intermediate forefoot region 117, comprised between the region of the heads of the metatarsal bones 121 and the distal region 118.

The ribs arranged in the external lateral median region 116, in the part that corresponds to the projection of the lateral longitudinal arch 120, follow the behavior of the resting of the foot, i.e., follow the projection of the lateral longitudinal arch on the planar extension of the sole of the foot. In this manner optimum support is provided.

The internal lateral median region 119 requires less support and therefore the ribs are arranged at a greater mutual distance, defining wider channels and facilitating greater ventilation with respect to the surface of the region of the projection of the lateral longitudinal arch 120, where the need to support the foot prevails with respect to the need for ventilation.

The channels in the internal lateral median region 119 are extended in a direction that is substantially perpendicular to the longitudinal direction of the foot.

The longitudinal direction of the foot is defined as the one that joins the forefoot to the heel.

The region of the heads of the metatarsal bones 121, also involved in the resting of the foot, requires a support similar to the region of projection of the lateral longitudinal arch 120, with which it shares the same arrangement of ribs and channels.

The foot at the intermediate forefoot region 117 is predominantly raised with respect to the ground.

At the intermediate forefoot region 117 the foot is also particularly rich in sweat glands, and therefore the need for adequate ventilation is dominant with respect to the need for support.

The ribs in this portion are arranged at a greater mutual distance than the external lateral median region 116, forming wider channels and thus facilitating effective ventilation.

Advantageously, in the intermediate forefoot region 117 the ribs and accordingly the channels are arranged in a transverse direction with respect to the foot, so as to facilitate the removal of the heat and of the sweat in the vapor phase along the shortest path.

Advantageously, the intermediate forefoot region 117 comprises a lobe-shaped portion 117*a*, which protrudes toward the distal forefoot region 118. In particular, the portion 117*a* preferably corresponds to the region comprised between the first and third toe of the foot.

The weight of the body, both in the static phase and in motion, is discharged mainly in the region 115, on the calcaneus, which is the biggest bone of the tarsus.

The surface of the sole of the foot at the calcaneus is further substantially free from sweat glands.

For these reasons, in the heel region 115 the need for foot support is dominant on the need for adequate ventilation.

In the heel region 115 the lining lacks ribs and channels.

The portion of the surface of the sole of the foot in the distal region 118 of the forefoot is affected by the propulsion phase of the foot and therefore requires adequate support in order to ensure effective propulsion.

The need for foot support is therefore dominant in the distal region 118.

The distal region 118 has a density and an arrangement of ribs and channels which are similar to the ones arranged in the external lateral median region 116.

In particular, the channels are preferably oriented along the longitudinal direction of the foot.

The outer lateral median region 116 and the distal region 118 are high-density regions.

In the high-density regions the ribs have a width comprised between 1 mm and 7 mm and the channels have a width comprised between 1 and 3 mm.

The internal lateral median region 119 is a medium-density region.

In the medium-density region, the ribs have a width comprised between 2 mm and 5 mm and the channels have a width comprised between 3 mm and 6 mm.

The intermediate region 117 of the forefoot is a low-density region.

In the low-density region, the ribs have a width comprised between 1 mm and 4 mm and the channels have a width comprised between 6 mm and 20 mm.

Advantageously, additional channels 114*a* can be arranged in a direction that is substantially transverse with respect to the channels 114 that are present, if there is the need to increase ventilation, for example in footwear intended for more intensive use, for example in the outer lateral median region 116, in which they are arranged along the direction that is transverse to the foot.

The transverse additional channels 114*a* can be arranged advantageously also in the distal region 118 for the same purposes.

The lateral portions 112*a* and 112*b* each have a plurality of channels 114 which are extended along the direction that goes from the respective edges 122*a* and 122*b* for interfacing with the sole 111 to the respective opposite edges 123*a* and 123*b*.

Proximate to the median region of the foot, the ribs are arranged at a greater mutual distance, forming wider channels in order to facilitate effective ventilation.

Vice versa, the regions closest to the heel and to the toe, which are more subject to wear and stresses, and in the regions where the need for foot containment during motion is predominant, the ribs are closer and the channels are less wide.

The channels of the lateral portions 112*a* and 112*b* extend so as to reduce as much as possible interruptions and crossings, in order to reduce the points of stagnation and/or interruption, which might cause the forming of condensation, of the flow of sweat in the vapor phase.

The width of the channels in the lateral portions 112*a* and 112*b* decreases as one moves away from the edges 122*a* and 122*b* and approaches the edges 123*a* and 123*b*.

Advantageously, the channels have a larger cross-section at the edges 122*a* and 122*b* and a smaller cross-section proximate to the edges 123*a* and 123*b*.

This difference in cross-section is adapted to generate an acceleration of the warm air and of the sweat in the vapor phase, which in a natural manner rise toward the upper portion of the footwear, facilitating their exit from the upper portion of the footwear.

The lining 110 according to the invention can be used in footwear in which the central portion can act as a foot resting surface without the need to use a footbed.

In this manner, a reduction of the cost of the footwear is achieved.

In this particular configuration, the lining can have regions in which the fabric has a differentiated thickness so as to follow the anatomy of the foot and in particular the geometry of the medial longitudinal arch and of the lateral longitudinal arch. In this case, the thickness of the fabric is greater for example at the medial longitudinal arch with respect to the lateral longitudinal arch.

Each one of the portions of the lining according to the invention is formed advantageously by a three-dimensional fabric.

The expression "three-dimensional fabric" is commonly understood to reference a single fabric the component fibers of which are arranged in a mutually perpendicular planar relationship.

From the point of view of the production process, in a weaving of the 3D type, the sets of fibers X and Y are woven with the rows and columns of the axial fibers Z. The expression "sets of fibers X and Y" is understood to reference the horizontal and vertical weft sets. The expression "fibers Z" is understood to reference the multilayer warp set.

It is possible to obtain three-dimensional fabrics also with weaving processes of the 2D type.

The three-dimensional fabric can be also obtained by knitting on flat or circular knitting machines.

The ribs and the channels can be obtained directly during the process for forming the fabric or subsequently, for example by thermoforming or a high-frequency heat-sealing process starting from a fabric that is fully or partially without channels.

If the ribs and the channels are obtained directly during the process for forming the fabric, they may have a sawtooth appearance due to the necessary discretization of the curved profiles in order to reproduce them by means of weaving processes.

Advantageously, the three-dimensional fabric can be composed of a monofilament yarn.

Advantageously, the three-dimensional fabric can comprise a plurality of layers: for example, a hydrophobic layer, which faces the body of the user, and a hydrophilic layer, which is arranged opposite.

Advantageously, it is possible to provide a napping process in order to give the surface of the layer that faces the body of the user a softer and more comfortable texture.

It is possible to use synthetic yarns, such as for example polyester, polypropylene or polyamide, or natural yarns, such as for example wool, cotton, linen.

Furthermore, the possibility to obtain channels directly on the fabric that constitutes the lining and/or the insole allows to eliminate resorting to channeled inserts made for example of polymeric foam or laminates comprising ethylene vinyl acetate (EVA) or polyurethane (PU), co-molded on a fabric, thus reducing the complexity and cost of the footwear.

In practice it has been found that the invention achieves the intended aim and objects, providing a lining for items of clothing, footwear and accessories, comprising a fabric with a plurality of channels alternated with ribs, characterized in that said channels at least partly have a differentiated width.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to the requirements and the state of the art.

The disclosures in Italian Patent Application No. 102017000107834 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A lining provided within items of clothing, footwear and accessories, comprising:

a plurality of channels alternated with ribs, wherein each of the plurality of channels and ribs is comprised of a fabric material, wherein the plurality of channels includes a region with a high density of channels, a region with a medium density of channels, and a region with a low density of channels, and wherein the plurality of channels in each of the region with the high density of channels, the region with the medium density of channels, and the region with the low density of channels, are symmetrical with respect to a medial plane of the lining, and wherein a rib of the medium density region branches into a plurality of ribs in the high density region.

2. The lining according to claim 1, wherein in said low-density regions said ribs have a width comprised between 1 mm and 4 mm and said channels have a width comprised between 6 mm and 20 mm.

3. The lining according to claim 1, wherein in said medium-density regions said ribs have a width comprised between 2 mm and 5 mm and said channels have a width comprised between 3 mm and 6 mm.

4. The lining according to claim 1, wherein in said high-density regions said ribs have a width comprised between 1 mm and 7 mm and said channels have a width comprised between 1 mm and 3 mm.

5. The lining according to claim 1, wherein each of the channels of high density region, the medium density region, and the low density region is configured to provide a fluid flow path from a first end of each respective channel to a second end of each respective channel.

6. The lining according to claim 5, wherein the fluid flow path for each of the channels of low density region are spaced apart from each channel of high density region.

7. The lining according to claim 1, wherein in the region with the low density of channels, an angle formed by the ribs and channels increases progressively with respect to the medial plane of the lining.

8. The lining according to claim 1, wherein in the region with the low density of channels, the ribs and channels are oriented along a vertical direction proximate to the medial plane.

9. The lining according to claim 1, wherein a plurality of channels of the medium density region merge into a same channel of the high density region.

10. The lining according to claim 1, wherein in each of the medium density region and the high density region, the channels form an angle between 30° and 60° with respect to the medial plane.

* * * * *